United States Patent [19]

Roden, Jr.

[11] Patent Number: 4,856,831

[45] Date of Patent: Aug. 15, 1989

[54] SECURITY DEVICE FOR AN OUTWARDLY SWINGING DOOR

[76] Inventor: Ralph V. Roden, Jr., P.O. Box 8276, Fort Worth, Tex. 76124

[21] Appl. No.: 239,009

[22] Filed: Aug. 30, 1988

Related U.S. Application Data

[63] Continuation of Ser. No. 752,483, Jul. 11, 1985, abandoned, which is a continuation of Ser. No. 529,208, Sep. 6, 1983, abandoned.

[51] Int. Cl.[4] ..... E05C 19/00

[52] U.S. Cl. ..... 292/259 R; 292/288

[58] Field of Search ..... 292/259 R, 259 A, 258, 292/260, 288, 289; 70/14, 19, 94; 49/463

[56] References Cited

U.S. PATENT DOCUMENTS

| | | | |
|---|---|---|---|
| 255,974 | 4/1882 | Hamlin | 292/260 |
| 450,261 | 4/1891 | Smith | 292/260 |
| 3,656,788 | 4/1972 | Emery . | |
| 3,819,216 | 6/1974 | Richardson . | |
| 3,863,968 | 2/1975 | Fraser | 292/260 |
| 3,919,807 | 11/1975 | Mefford . | |
| 3,980,328 | 9/1976 | Pearson . | |
| 4,082,332 | 4/1978 | Palmer | 292/259 R |
| 4,330,147 | 5/1982 | Nolen | 292/259 R |
| 4,356,580 | 11/1982 | Kurtz | 70/14 |

FOREIGN PATENT DOCUMENTS

| | | | |
|---|---|---|---|
| 135411 | 4/1952 | Sweden | 70/14 |
| 102494 | 12/1923 | Switzerland | 292/288 |
| 572147 | 1/1976 | Switzerland | 292/260 |

OTHER PUBLICATIONS

"Phoenix Defender Series 10–40", Brochure.

*Primary Examiner*—Gary L. Smith
*Assistant Examiner*—Michael J. Milano
*Attorney, Agent, or Firm*—Fleit, Jacobson, Cohn, Price, Holman & Stern

[57] ABSTRACT

A security device for an outwardly swining door is shown for use on a door having an interior and exterior door walls and which is mounted in a door frame having opposed, upright door facings. The device includes a pair of restraining bars, one of which is stationary and affixed to the interior wall of the door. The stationary bar is arranged generally perpendicular to and spaced-apart from the door facings on the interior wall of the door. The stationary bar has an opening formed at either end thereof which is adapted to receive the mounting member of a removable bar which overlays the stationary bar and spans the door facings when in place to prevent the door from swining outwardly. The mounting elements of the removable bar are adjustable in length to accommodate doors of various sizes and include curved end portions which are received within the stationary bar openings to thereby mount the removable bar on the stationary bar.

2 Claims, 1 Drawing Sheet

SECURITY DEVICE FOR AN OUTWARDLY SWINGING DOOR

This application is a continuation of application Ser. No. 752,483, filed July 11, 1985, which was a continuation of application Ser. No. 529,208, filed Sept. 6, 1983, both abandoned.

BACKGROUND OF THE INVENTION

The present invention relates generally to security devices for barring the door of a doorway and, specifically, to a door bar device mounted on the inside of an outwardly swinging door to prevent unauthorized opening of the door.

In recent years, outwardly swinging door have become increasingly popular, especially on commerical buildings. Such doors are typically mounted in a door frame with the hinges situated along one vertical side of the door in the space between the door and the adjacent upright facing of the door frame. Such doors are especially suited for commercial buildings where fire regulations require an outwardly swinging exit door.

Since exit doors are often located at the side or rear of a commercial building, they present a security risk and are often the target of crimes against property such as breaking and entering and burglary. There exists a need for a security device for mounting within the interior of a building fitted with an outwardly swinging door which would prevent forced entry from the exterior of the building through the door.

While various security bars for doors are shown in the prior art, these devices have generally been found to be deficient in several respects. Certain of the prior devices have been overly complicated and expensive to manufacture. Other of the prior devices required drastic modification of the door frame of the building for installing the device. Other of the devices were always in place on the door, even when not in use, thereby detracting from the appearance of the door. Other of the prior devices were difficult to dismantle or disengage in order to, for instance, open the door of the building during an emergency such as a fire.

SUMMARY OF THE INVENTION

The security device of the invention is intended to be used on an outwardly swinging door of the type having an interior and an exterior door wall and which is mounted in a door frame having opposed, upright door facings. The device includes a stationary bar which is affixed to the interior wall of the door generally perpendicular to and spaced-apart from the door facings. The stationary bar has at least two openings formed at the opposite ends thereof. The device also includes a removable bar which is adapted to be removably mounted on the stationary bar. The removable bar is of greater relative length than the stationary bar allowing the removable bar to span the door facings and prevent the door from swinging outwardly when the removable bar is in place on the stationary bar. A pair of mounting elements are present on the removable bar. Each mounting element has a shaft portion which is secured within a retaining hole provided in the removable bar. The end of the mounting element opposite the point of connection to the removable bar is L-shaped and adapted to be received within the stationary bar openings to thereby mount the removable bar on the stationary bar.

Additional objects, features and advantages will be apparent in the written description which follows.

DETAILED DESCRIPTION OF THE INVENTION

Figure 1:
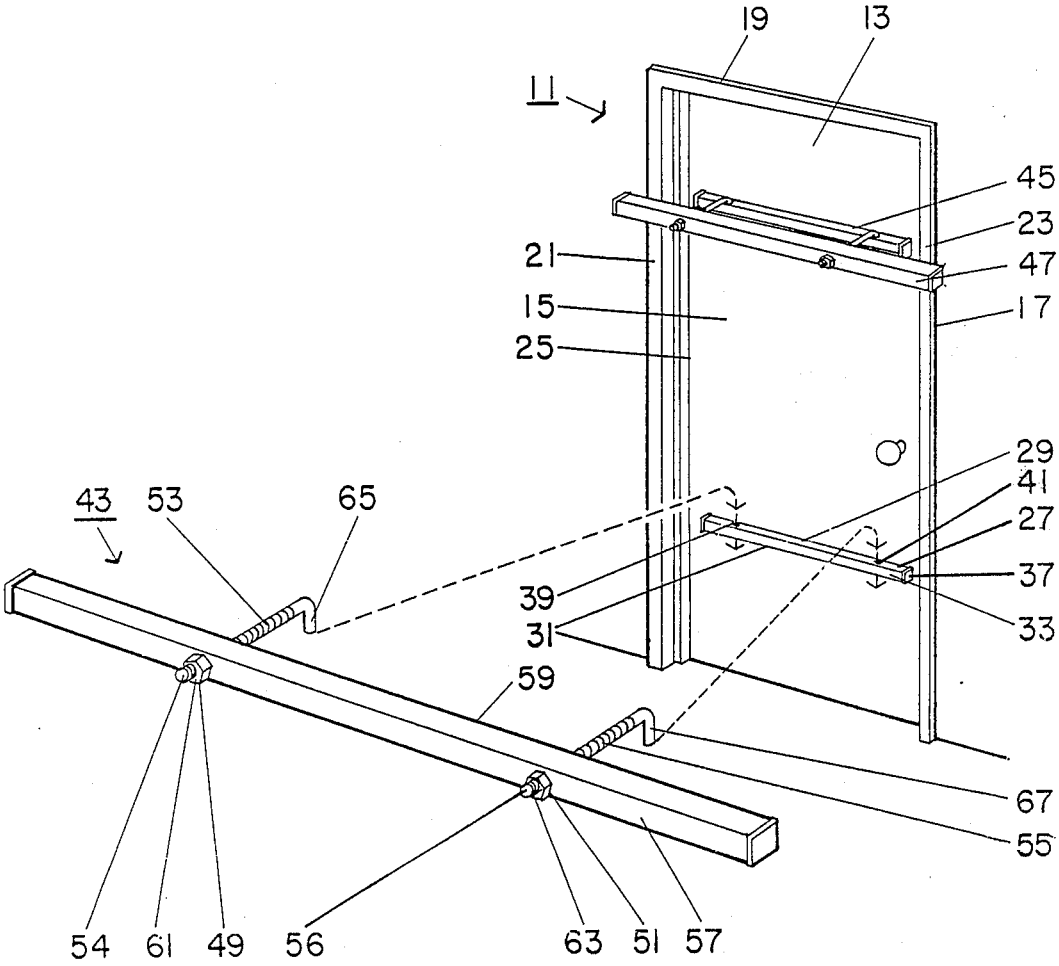
FIG. 1 is a perspective view of an outwardly swinging door with a security device of the invention in place on the door and illustrating the assembly of a second security device onto the door.

FIG. 1 shows a security device of the invention designated generally as 11 shown mounted on an outwardly swinging door 13. The door 13 has an interior wall 15, an exterior wall 17 and is mounted in a door frame 19 having opposed upright door facings 21, 23 and a conventionally provided doorstop. The hinges of the door 13 (not shown) fit within the space between the outer vertical edge 25 of the door and the door facing 21 in the conventional manner so that the door swings outwardly.

The security device of the invention, as shown in FIG. 1, includes a stationary bar 27 which is affixed to the interior wall 15 of the door 13 generally perpendicular to and spaced-apart from the door facings 21, 23. The stationary bar 27 is a hollow, tubular metal bar of generally square cross-section. The bar 27 has top and bottom side walls 29, 31 and front and rear sidewalls 33, 35, respectively. The bar 27 can be cut to the desired length from commercially available stock and the ends can be covered with plastic end pieces 37. The stationary bar 27 has at least two openings 39, 41 at the opposite ends thereof. The openings 39, 41 extend through the top and bottom sidewalls 29, 31.

The security device 11 also includes a removable bar 43 which is adapted to be removably mounted on the stationary bar 27. The removable bar 43 is a hollow, tubular, metal bar similar in construction to stationary bar 27 but of greater relative length than stationary bar 27. Removable bar 43 is adapted to span the door facings 21, 23 when in place on the stationary bar, as shown by the assembled bars 45, 47 in FIG. 1.

The removable bar 43, as shown in close-up detail in FIG. 1, has a retaining hole 49, 51 provided at each end thereof into which is received the threaded shaft portion or long leg 53, 55 of a mounting bolt 54, 56. The retaining holes 49, 51 extend through the front and rear sidewalls 57, 59 of the removable bar 43 with the mounting bolts 54, 56 being retained within the holes 49, 51 by means of nuts 61, 63 which are threadedly received on the ends of the threaded shafts 53, 55 extending through the front sidewall 57.

The mounting bolts also include a curved L-shaped end portion or short leg 65, 67 which extend generally normal to the longitudinal axis of the threaded shaft portion 53, 55. The retaining holes 49, 51 are selectively spaced apart on the removable bar 43 to allow the curved end portions 65, 67 to be received within the mating stationary bar opening 39, 41 to thereby mount the removable bar 43 on the stationary bar 27.

The operation of the present invention will now be described. To install the security device of the invention on an outwardly swinging door 13, the stationary bar 27 is first affixed to the door as by bolting the bar to the door. The stationary bar is mounted on the door 13 generally perpendicular to the door facings 21, 23 and spaced apart from the door facings so that the door can be swung outwardly when the removable bar is not in place. When it becomes desirable to secure the door 13, the removable bar 43 is mounted on the stationary bar by placing the curved end portion 65, 67 of the mounting bolts within the openings 39, 41 of the stationary bar allowing the curved end portions 65, 67 to extend completely through the top and bottom sidewalls 29, 31 thereof. The removable bar 43 can be adjusted to an exact fit on doors having door facings 21, 23 of various thicknesses by means of the threaded shaft portions 53, 55 and nuts 61, 63 of the mounting members. In other words, the distance between the curved end portions 65, 67 and the removable bar rear sidewall 59 can be determined by selectively positioning the nuts 61, 63 on the threaded shaft portion extending from the front sidewall 57 of the bar 43 to accommodate various sizes of door facings.

An invention has been provided with significant advantages. The security device of the invention is simple in design and inexpensive to manufacture. The device is easy to install and simple to remove should speed of disassembly be important, as in an emergency. The adjustable mounting members allow the same design to be used on doors of various sizes by simply repositioning the adjusting nuts thereby reducing the cost of manufacturing the device.

While the invention has been shown in only one of its forms, it is not thus limited but is susceptible to various changes and modifications without departing from the spirit thereof.

I claim:

1. In combination, a door mounted on a door frame for swinging movement between open and closed position, said door frame having a door stop preventing swinging movement of the door in one direction with the door engaging the door stop when in closed position and a security device releasably retaining the door in closed position against the door stop by preventing swinging movement of the door away from the door stop, said security device comprising an elongated, rigid, one-piece bar mounted on the door surface that engages the door stop when the door is in closed position, said bar extending continuously from end-to-end and extending along substantially the entire distance between opposite edges of the door, said bar extending laterally from the door surface a distance less than the distance between the surface of the door stop engageable by the door and the edge of the door frame remote from the door when in closed position, said bar including at least a pair of parallel openings extending vertically therethrough, said openings being parallel to the door surface on which the bar is mounted, said security device also comprising an elongated, rigid, one-piece, removable locking bar having a length greater than the door mounted bar with the ends of the removable bar extending beyond opposed edges of the door and disposed in spaced relation to the door mounted bar with the ends of the removable bar engaging the door frame at opposite edges thereof and means on the removable bar engaged with the openings in the door mounted bar to retain the removable bar mounted from the door mounted bar with the ends of the removable bar engaged with the edges of the door frame thereby preventing movement of the door away from the door stop, said means comprising at least a pair of L-shaped membes having a long leg and a short leg perpendicular to the long leg, the long leg of each L-shaped member being connected to said removable bar with the short leg of each L-shaped member extending vertically downwardly from the end of the long leg and received in an opening in said door mounted bar and entering the opening from the upper end and enabling quick removal of the removable bar by lifting the removable bar upwardly to lift the short legs out of the opening in the door mounted bar, each L-shaped member being of one-piece construction and having a substantially constant cross-sectional area and shape throughout its length, said removable bar having at least a pair of holes along a center line thereof for receiving the long legs of said L-shaped members, each of the long legs being threaded, and nut means on said threaded legs to secure said removable bar to said L-shaped members, each of said L-shaped members, openings and holes having a circular cross-section with the holes in the removable bar being spaced apart a distance equal to the distance between the openings in the door mounted bar, said nut means enabling adjustment of the distance between the door mounted bar and the removable bar when the short legs of the L-shaped members are positioned in the openings to enable installation of the security device on doors and door frames having dimensional variations between the door surface and edge of the door frame, the surface of said door mounted bar engaging the door surface being flat and generally rectangular in configuration, the surface of said removable bar engaging the edges of the door frame being flat and generally rectangular with the flat surface of the removable bar being supported in parallel relation to the flat surface on the door mounted bar by engagement of the short legs of the L-shaped members in said openings.

2. The combination as defined in claim 1 wherein each of said bars is of hollow construction and rectangular in crosssectional configuration with the openings extending through vertically opposed walls of the door mounted bar with the short legs extending freely through the opening in both opposed walls, said holes in the removable bar being formed in horizontally opposed walls with the longer leg extending through both opposed walls, said door and door frame being vertically disposed in a wall opening with the door swinging outwardly from the door stop toward open position with the bars positioned interiorly of the door and door frame thereby enabling quick removal by simply lifting the removable bar upwardly to move the short legs upwardly out of the openings for rapidly removing the removable bar.

* * * * *